US010119241B2

(12) United States Patent
Hanafusa et al.

(10) Patent No.: US 10,119,241 B2
(45) Date of Patent: Nov. 6, 2018

(54) WORK IMPLEMENT, ARM, AND WORK VEHICLE

(71) Applicant: KOMATSU LTD., Tokyo (JP)

(72) Inventors: Teruhisa Hanafusa, Hirakata (JP); Koji Ohigashi, Hirakata (JP); Shinobu Kitayama, Hirakata (JP)

(73) Assignee: KOMATSU LTD., Tokyo (JP)

( * ) Notice: Subject to any disclaimer, the term of this patent is extended or adjusted under 35 U.S.C. 154(b) by 122 days.

(21) Appl. No.: 15/324,083

(22) PCT Filed: Aug. 1, 2016

(86) PCT No.: PCT/JP2016/072536

§ 371 (c)(1),
(2) Date: Jan. 5, 2017

(87) PCT Pub. No.: WO2018/025310

PCT Pub. Date: Feb. 8, 2018

(65) Prior Publication Data

US 2018/0179726 A1 Jun. 28, 2018

(51) Int. Cl.

| | |
|---|---|
| ***E02F 3/36*** | (2006.01) |
| ***E02F 3/38*** | (2006.01) |
| ***E02F 9/22*** | (2006.01) |

(52) U.S. Cl.

CPC ..... *E02F 3/36* (2013.01); *E02F 3/38* (2013.01); *E02F 9/2275* (2013.01)

(58) Field of Classification Search

CPC ..... E02F 3/34; E02F 3/36; E02F 3/38; E02F 9/2275

See application file for complete search history.

(56) References Cited

U.S. PATENT DOCUMENTS 4,265,063 A * 5/1981 Muller ..... B66C 13/12 137/377
4,658,854 A * 4/1987 Hopkins ..... F16L 3/223 137/355.17

(Continued)

FOREIGN PATENT DOCUMENTS

DE 102 39 746 B4 5/2007
JP 2002-180493 A 6/2002

(Continued)

OTHER PUBLICATIONS

The International Search Report for the corresponding international application No. PCT/JP2016/072536, dated Oct. 4, 2016.

(Continued)

*Primary Examiner* — Kaitlin S Joerger
(74) *Attorney, Agent, or Firm* — Global IP Counselors, LLP

(57) ABSTRACT

An arm includes an arm main body, a protective member, a fixing component and a restrictor. The arm main body has a distal end part with first and second end components disposed a specific space apart along a width direction, a bucket attached to the arm main body, and a proximal end part configured to allow attachment on a vehicle main body side. The protective member covers the specific space. The fixing component is disposed on a proximal end part side of the specific space and fixes the protective member to the arm main body. A restrictor is disposed between the first and second end components along the width direction, and restricts movement of the protective member. A work vehicle includes a vehicle main body and the arm. A work implement includes a boom pivotably attachable to a vehicle main body and the arm attached to the boom.

10 Claims, 13 Drawing Sheets

(56) References Cited

U.S. PATENT DOCUMENTS

| | | | | |
|---|---|---|---|---|
| 5,806,313 | A * | 9/1998 | Koshi | E02F 3/38 414/722 |
| 9,016,335 | B2 * | 4/2015 | Camps | A01G 23/081 144/251.1 |
| 2003/0210972 | A1 | 11/2003 | Yukawa et al. | |
| 2009/0084454 | A1 * | 4/2009 | Son | E02F 3/325 137/899 |
| 2011/0274528 | A1 | 11/2011 | Cate et al. | |

FOREIGN PATENT DOCUMENTS

| | | | |
|---|---|---|---|
| JP | 3120853 | U | 4/2006 |
| JP | 2006-132224 | A | 5/2006 |
| JP | 2007-177435 | A | 7/2007 |
| JP | 2012-241347 | A | 12/2012 |
| WO | 2010/087792 | A1 | 8/2010 |

OTHER PUBLICATIONS

The Office Action for the corresponding Australian application No. 2016294628, dated Aug. 22, 2017.
The Office Action for the corresponding German application No. 11 2016 000 068.5, dated Dec. 4, 2017.

* cited by examiner

WORK IMPLEMENT, ARM, AND WORK VEHICLE

CROSS-REFERENCE TO RELATED APPLICATIONS

This application is a U.S. National stage application of International Application No. PCT/JP2016/072536, filed on Aug. 1, 2016.

BACKGROUND

Field of the Invention

The present invention relates to a work implement, an arm, and a work vehicle.

Background Information

With a large hydraulic excavator, because of the large size of the bucket, a great deal of power is needed for rotation, and two hydraulic cylinders are sometimes used. In a case such as this, the distal end of the arm branches in two, the distal ends of which are rotatably attached to the bracket of the bucket (see Japanese Laid-Open Patent Application 2006-132224, for example).

FIG. 11 shows the configuration of a boom 1800, an arm 1100, and a bucket 1200 in a conventional hydraulic excavator. In FIG. 11, the bucket 1200 is attached to the arm 1100 so that its opening faces to the rear of the vehicle.

With a hydraulic excavator such as this, a flat protector 1300 is disposed as a protective member to the distal ends of the arm 1100 so that soil excavated by the bucket 1200 will not fall into the space 1000S between the two distal ends of the arm 1100.

Meanwhile, if the arm 1100 should be twisted during the drive of the hydraulic excavator, there will be greater twisting at the forked portion of the distal end of the arm 1100. Accordingly, the protector 1300 is fixed to the arm 1100 at the portion on the proximal end part side, but is not fixed to the arm 1100 at the portion on the distal end part side, and a restricting member is attached to the arm 1100 so as to restrict movement resulting from this distortion. The conventional structure for attaching the protector 1300 to the arm 1100 will now be described.

FIG. 12 is a detail view of the distal end of the arm 1100, and shows a state in which the protector 1300 has been removed. As shown in the drawing, the distal end of the arm 1100 is divided into a first end component 1110 and a second end component 1120, and the above-mentioned spaces 1000S is formed between the first end component 1110 and the second end component 1120. A seat 1400 is provided to the surface of the aim 1100 so as to surround the space 1000S. The protector 1300 is bolted to this seat 1400.

As shown in FIG. 12, the seat 1400 is made up of a first seat 1410 disposed along the first end component 1110, a second seat 1420 disposed along the second end component 1120, and a third seat 1430 disposed on the edge on the boom 1800 (see FIG. 12) side of the space 1000S. Two bolts 1500 are disposed in the third seat 1430 in the width direction of the arm 1100, and four bolts 1500 are disposed in each of the first seat 1410 and the second seat 1420 along the lengthwise direction of the arm 1100.

FIG. 13 is a cross section of a state in which the protector 1300 is fixed to the seat 1400. FIG. 13 shows the contact portions of the first seat 1410 and the protector 1300, but the configuration is the same for the contact portions of the second seat 1420 and the protector 1300.

As shown in FIG. 13, the two bolts 1500 on the proximal end part side press the protector 1300 against the first seat 1410 via washers 1600. Thus, the protector 1300 is fixed to the first seat 1410 by the bolts 1500.

Meanwhile, substantially cylindrical collars 1700 having a large-diameter part 1710 and a small-diameter part 1720 are fitted to the two bolts 1500 on the distal end part side. FIG. 14 is a detail view of the area near a portion of the two bolts 1500 on the distal end part side in FIG. 13. These collars 1700 are pressed against the first seat 1410 by the bolts 1500 and thereby fixed to the first seat 1410.

In a state in which the hydraulic excavator is not operating, a gap is formed between the collars 1700 and the protector 1300, and the collars 1700 and the protector 1300 are not to touching. More precisely, in the axial direction of the collars 1700, a gap G1001 is formed between the large-diameter part 1710 and the protector 1300, and in the radial direction thereof, a gap G1002 is formed between the small-diameter part 1720 and the protector 1300.

Thus, the configuration is such that just the proximal end part side of the protector 1300 is fixed to the arm 1100, but the distal end part side of the protector 1300 is not fixed to the arm 1100 and restricts distortion of the protector 1300.

SUMMARY

However, even when a gap is formed between the collars 1700 and the protector 1300 as in the above-mentioned conventional configuration, depending on the amount of distortion of the arm 1100, the collars 1700 and the protector 1300 may still come into contact, resulting in more stress being produced between the seat 1400 and the protector 1300.

In light of the above problems encountered in the past, it is an object of the present invention to provide a work implement, an arm, and a work vehicle with which the stress produced in the attachment structure of a protective member can be reduced.

To achieve the stated object, the work vehicle pertaining to a first aspect comprises a vehicle main body and an arm, said arm having an arm main body, a protective member, a fixing component, and a restrictor. The arm main body has a distal end part and a proximal end part. The distal end part includes a first end component and a second end component disposed a specific space apart in the width direction, and a bucket is attached to the distal end part. The proximal end part is configured to allow attachment on the vehicle main body side. The protective member covers said specific space. The fixing component is disposed on the proximal end part side of the specific space and fixes the protective member to the arm main body. The restrictor is disposed between the first end component and the second end component in the width direction, and restricts the movement of the protective member.

Here, the restrictor that restricts the movement of the protective member is disposed between the first end component and the second end component in the width direction. If the arm main body should be twisted by operation of the hydraulic excavator, there will be less twisting on the inside than the outside in the width direction of the arm main body.

Accordingly, disposing the restrictor between the first end component and the second end component in the width direction reduces the stress that is produced in the structure in which the protective member is attached to the arm main body, even if twisting occurs in the arm main body.

The work vehicle pertaining to a second aspect is the work vehicle pertaining to the first aspect, wherein a gap is formed in at least part of the region between the restrictor and the protective member.

Consequently, the protective member is not fixed to the arm main body on the distal end part side where twisting is apt to occur, but the protective member can be fixed on the proximal end part side where twisting is less likely to occur. Accordingly, the stress generated at the restrictor can be reduced on the distal end part side where stress is more likely to occur.

The work vehicle pertaining to a third aspect is the work vehicle pertaining to the first aspect, the restrictor has a seat and a restricting member. The seat is fixed to at least one of the side face on the specific space side of the first end component and the side face on the specific space side of the second end component. The restricting member is fixed to the seat via a through-hole formed in the protective member. A gap is formed between the restricting member and the protective member.

Thus disposing the seat on at least one of the inside of the first end component and the inside of the second end component reduces the stress produced in the connected portion between the seat and the arm main body more than when the seat is provided on the surfaces of the first end component and second end component, which are on the outside.

The work vehicle pertaining to a fourth aspect is the work vehicle pertaining to the third aspect, wherein the restricting member is a cylindrical member, and has a small-diameter part that comes into contact with the seat, and a large-diameter part provided on the opposite side of the seat from the small-diameter part. The gap is formed between the protective member and the large-diameter part in the axial direction of the restricting member, and between the protective member and the small-diameter part in the radial direction of the restricting member.

Since the restricting member is such that a gap is formed between itself and the protective member in its axial direction and radial direction, the stress produced in the restricting member and the seat can be moderated when the arm main body twists.

The work vehicle pertaining to a fifth aspect is the work vehicle pertaining to the third aspect, wherein the seat is disposed on both the side face on the specific space side of the first end component, and the side face on the specific space side of the second end component. The restricting member is fixed to each of the seats.

When twisting occurs in the arm main body, there is less twisting on the inside than the outside in the width direction of the arm main body, so the stress produced in the restricting member and the seat can be reduced.

The work vehicle pertaining to a sixth aspect is the work vehicle pertaining to the second aspect, wherein the protective member has a protrusion. This protrusion is fixed to the face of the protective member main body that is opposite the arm main body, more on the restrictor side of the arm than the fixing component.

Consequently, when soil, rock, or the like hits the protective member, the impact on the protective member is borne by not only the restrictor, but also by the protrusion colliding with the arm main body. Accordingly, less of a load is exerted on the portion of the restrictor that is connected to the arm main body during collision with soil.

The work vehicle pertaining to a seventh aspect is the work vehicle pertaining to the sixth aspect, wherein the restrictor has a seat and a restricting member. The seat is fixed to at least one of the side face on the specific space side of the first end component and the side face on the specific space side of the second end component. The restricting member is fixed to the seat via a through-hole formed in the protective member. A gap is provided between the seat and the protective member main body. A gap is also formed between the protrusion and the arm main body. The gap between the protrusion and the aim main body is smaller than the gap between the seat and the protective member main body.

Consequently, the impact on the protective member when soil, rock, or the like hits the protective member is borne by having the protrusion collide with the arm main body prior to the restrictor. Accordingly, less of a load is exerted on the portion of the restrictor that is connected to the arm main body during collision with soil.

The work vehicle pertaining to an eighth aspect is the work vehicle pertaining to the sixth aspect, wherein the protrusion is provided in at least two places that are opposite each other on the first end component and the second end component. The protrusions are formed in a rod shape along the first end component and the second end component.

When the protrusions are thus formed in a rod shape, the impact that occurs as a result of the collision of soil or the like with the protective member can be borne over a larger surface area.

The arm pertaining to a ninth aspect has an arm main body, a protective member, a fixing component, and a restrictor. The arm main body has a distal end part and a proximal end part. The distal end part has a first end component and a second end component disposed a specific space apart in the width direction, and a bucket is attached to the distal end part. The proximal end part is configured to allow attachment on the vehicle main body side. The protective member covers said specific space. The fixing component is disposed on the proximal end part side of the specific space and fixes the protective member to the arm main body. The restrictor is disposed between the first end component and the second end component in the width direction, and restricts to the movement of the protective member.

Here, the restrictor that restricts the movement of the protective member is disposed between the first end component and the second end component in the width direction. If the arm main body should be twisted by operation of the hydraulic excavator, there will be less twisting on the inside than the outside in the width direction of the arm main body.

Accordingly, disposing the restrictor between the first end component and the second end component in the width direction reduces the stress that is produced in the structure in which the protective member is attached to the arm main body, even if twisting occurs in the arm main body.

The work implement pertaining to a tenth aspect comprises a boom, a bucket, and an arm. The boom can be pivotably attached to a vehicle main body. The arm is attached to the boom. The bucket is attached to the arm. The arm has an arm main body, a protective member, a fixing component, and a restrictor. The arm main body has a distal end part and a proximal end part. The distal end part includes a first end component and a second end component disposed a specific space apart in the width direction, and a bucket is attached to the distal end part. The proximal end part is attached to the boom. The protective member covers said specific space. The fixing component is disposed on the proximal end part side of the specific space and fixes the protective member to the arm main body. The restrictor is disposed between the first end component and the second end component in the width direction, and restricts the movement of the protective member.

Here, the restrictor that restricts the movement of the protective member is disposed between the first end component and the second end component in the width direction. If the arm main body should be twisted by operation of the hydraulic excavator, there will be less twisting on the inside than the outside in the width direction of the arm main body.

Accordingly, disposing the restrictor between the first end component and the second end component in the width direction reduces the stress that is produced in the structure in which the protective member is attached to the arm main body, even if twisting occurs in the arm main body.

The present invention provides a work implement, an arm, and a work vehicle with which the stress produced in the attachment structure of a protective member can be reduced.

DETAILED DESCRIPTION OF EMBODIMENT

The revolving apparatus of a work vehicle pertaining to an embodiment of the present invention will now be described through reference to the drawings.

1. Configuration 1-1. Outer Configuration of Hydraulic Excavator

Figure 1:
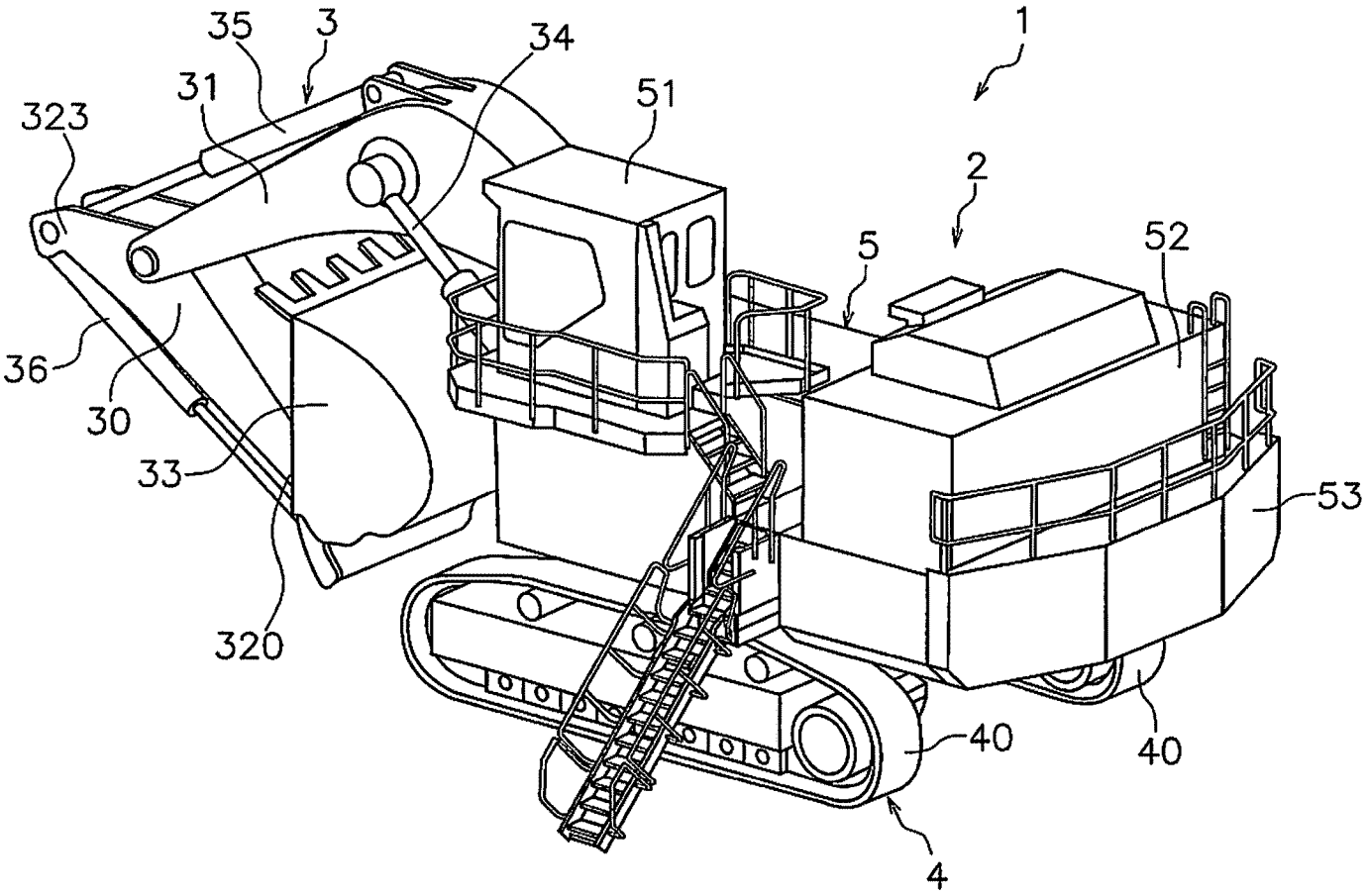
FIG. 1 is an oblique view of a hydraulic excavator in an embodiment pertaining to the present invention.

FIG. 1 is an oblique view of the hydraulic excavator in this embodiment. The hydraulic excavator 1, which is an example of a work vehicle, mainly comprises a vehicle main body 2 and a work implement 3. The vehicle main body 2 has a lower traveling unit 4 having crawler belts 40 provided on the left and right ends in the travel direction, and an upper structure 5 disposed on top of the lower traveling unit 4. The upper structure 5 is provided with an operator's room 51, an engine compartment 52, a counterweight 53, etc. The operator's room 51 is disposed on the front-left side of the upper structure 5. The engine compartment 52 is disposed to the rear of the operator's room 51. The counterweight 53 is disposed at the rear end of the upper structure 5.

Unless otherwise specified in this embodiment, the terms front, rear, left and right here will use the operator's seat in the operator's room 51 as a reference. The direction in which the operator's seat faces forward shall be the forward direction, and the direction that is opposite the forward direction shall be the rearward direction. The right side and left side in the lateral direction when the operator's seat faces forward shall be the right direction and left direction.

The work implement 3 has a boom 31, an arm 30, and a bucket 33, and is attached in the front-center of the upper structure 5. The proximal end part of the boom 31 is rotatably linked to the upper structure 5. The distal end part of the boom 31 is rotatably linked to the proximal end part 323 of the arm 30. The distal end part 320 of the arm 30 is rotatably linked to the bucket 33. The bucket 33 is attached to the arm 30 so that its opening 33*a* (see FIG. 2) can face in the direction of the vehicle main body 2 (rearward). A hydraulic excavator in which the bucket 33 is attached in this orientation is called a backhoe.

Two each of a boom cylinder 34, arm cylinder 35, and bucket cylinder 36 are also provided corresponding to the boom 31, the arm 30, and the bucket 33, respectively. The boom cylinders 34, the arm cylinders 35, and the bucket cylinders 36 are hydraulic cylinders, and when these are driven, they drive the work implement 3 to carry out excavation or other such work.

1-2. Arm

The arm 30 mainly has an arm main body 32, a first protector 6, a second protector 7, and an attachment component 8.

The arm main body 32 has the above-mentioned distal end part 320 and proximal end part 323. The distal end part 320 rotatably links the bucket 33 as discussed above. The proximal end part 323 is rotatably linked to the distal end of the boom 31.

The first protector 6 and the second protector 7 protect the distal end part 320. The attachment component 8 attaches the first protector 6 to the distal end part 320.

1-2-1. Configuration of Distal End Part of Arm

Figure 2:
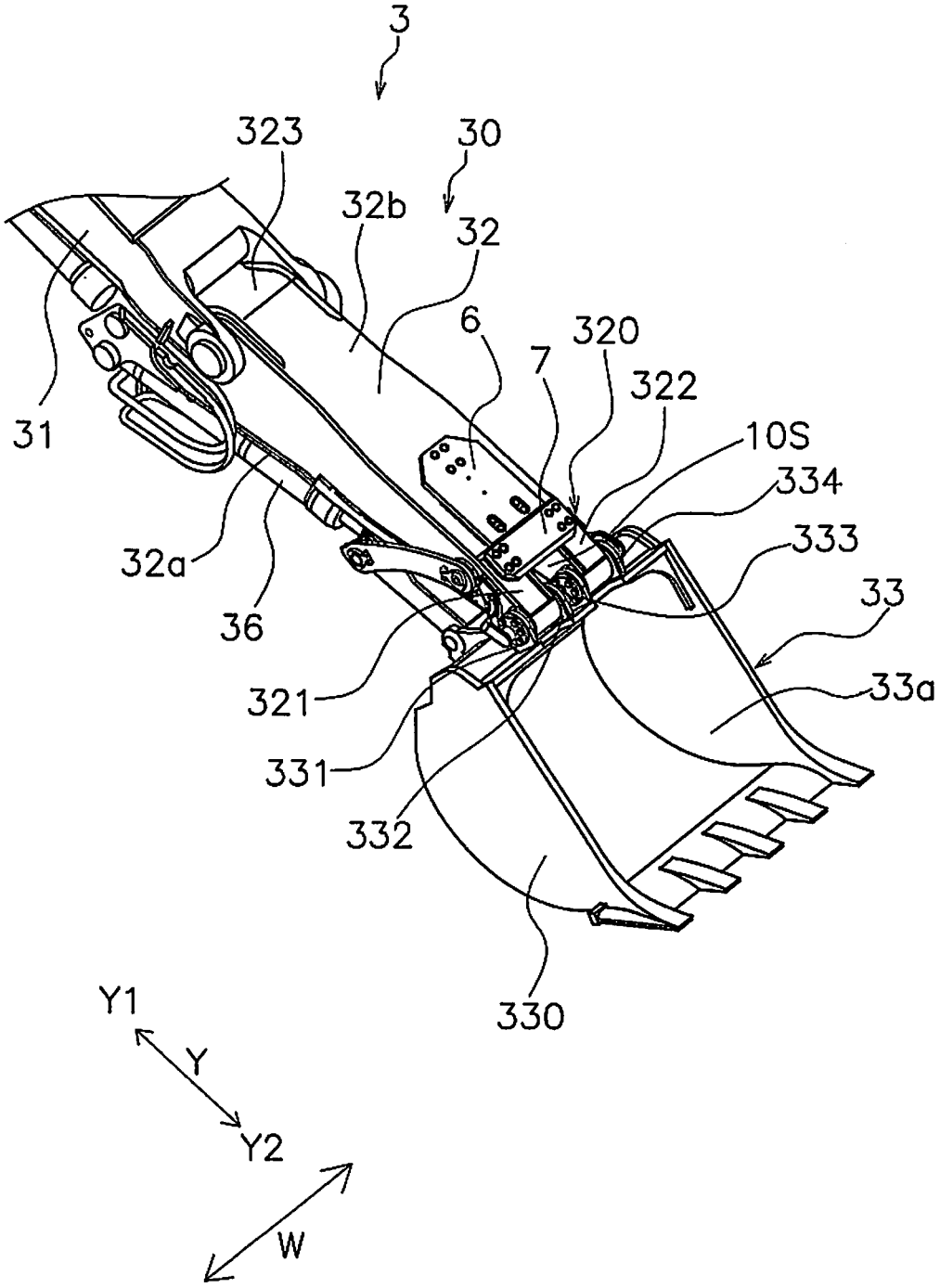
FIG. 2 is a detail view of the configuration near the arm of the hydraulic excavator in FIG. 2.
Figure 3:
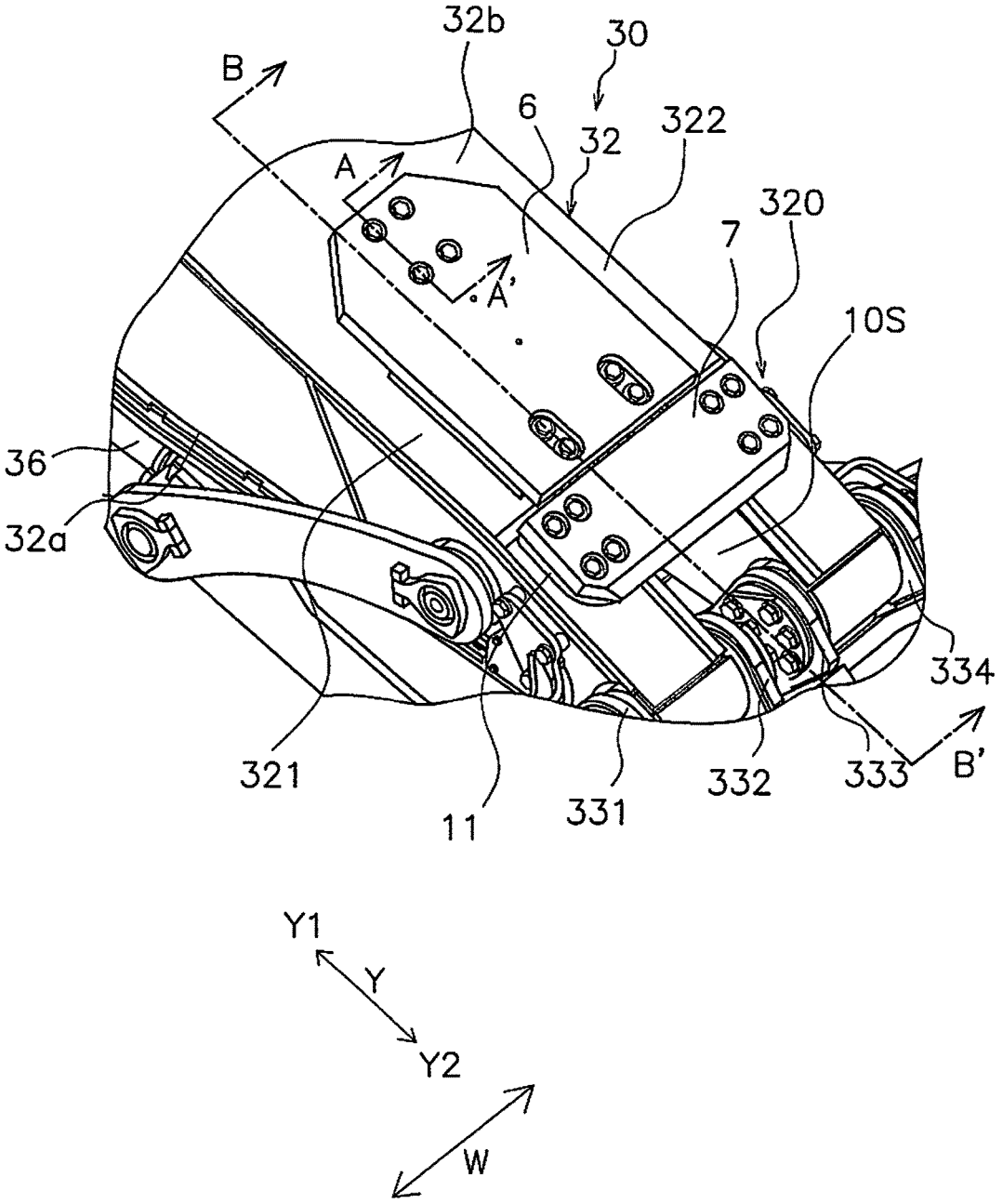
FIG. 3 is a detail view of the configuration near the distal end part of the arm in FIG. 2.

FIG. 2 is a detail oblique view of the distal end portion of the work implement 3. FIG. 3 is a detail view of FIG. 2.

The bucket 33 has a bucket main body 330 that scoops up soil, and a first bracket 331, a second bracket 332, a third bracket 333, and a fourth bracket 334 that are provided to the rear face of the bucket main body 330. The first bracket 331, the second bracket 332, the third bracket 333, and the fourth bracket 334 are disposed along the width direction of the bucket 33 (see the arrow W). The width direction W can also be called the width direction of the arm 30. The lengthwise direction of the arm main body 32 is labeled Y, the proximal end part 323 side is indicated by the arrow Y1, and the distal end part 320 side is indicated by the arrow Y2.

The distal end part 320 of the arm main body 32 to which the bucket 33 is attached branches in two, having a first end component 321 and a second end component 322. The first end component 321 and the second end component 322 are disposed a specific space 10S apart in the width direction W.

The first end component 321 is inserted between the first bracket 331 and the second bracket 332 of the bucket 33, and is rotatably attached to the first bracket 331 and the second bracket 332 by a link pin (not shown).

The second end component 322 is inserted between the third bracket 333 and the fourth bracket 334 of the bucket 33, and is rotatably attached to the third bracket 333 and the fourth bracket 334 by a link pin (not shown).

The two bucket cylinders 36 (only one is shown in FIG. 2) are disposed corresponding respectively to the linked portion of the first end component 321 and the bucket 33 and the linked portion of the second end component 322 and the bucket 33. The two bucket cylinders 36 are provided on a first face 32*a* side of the arm main body 32, which is on the opposite side from the vehicle main body 2.

The first protector 6 and the second protector 7, which are disposed so as to cover the space 10S between the first end component 321 and the second end component 322, are provided to a second face 32*b* of the arm main body 32, which is on the same side as the vehicle main body 2.

The first protector 6 and the second protector 7 are provided in order to prevent soil, rock, or the like excavated by the bucket 33 from going in between the first end component 321 and the second end component 322.

1-2-2. First Protector 6

Figure 4:
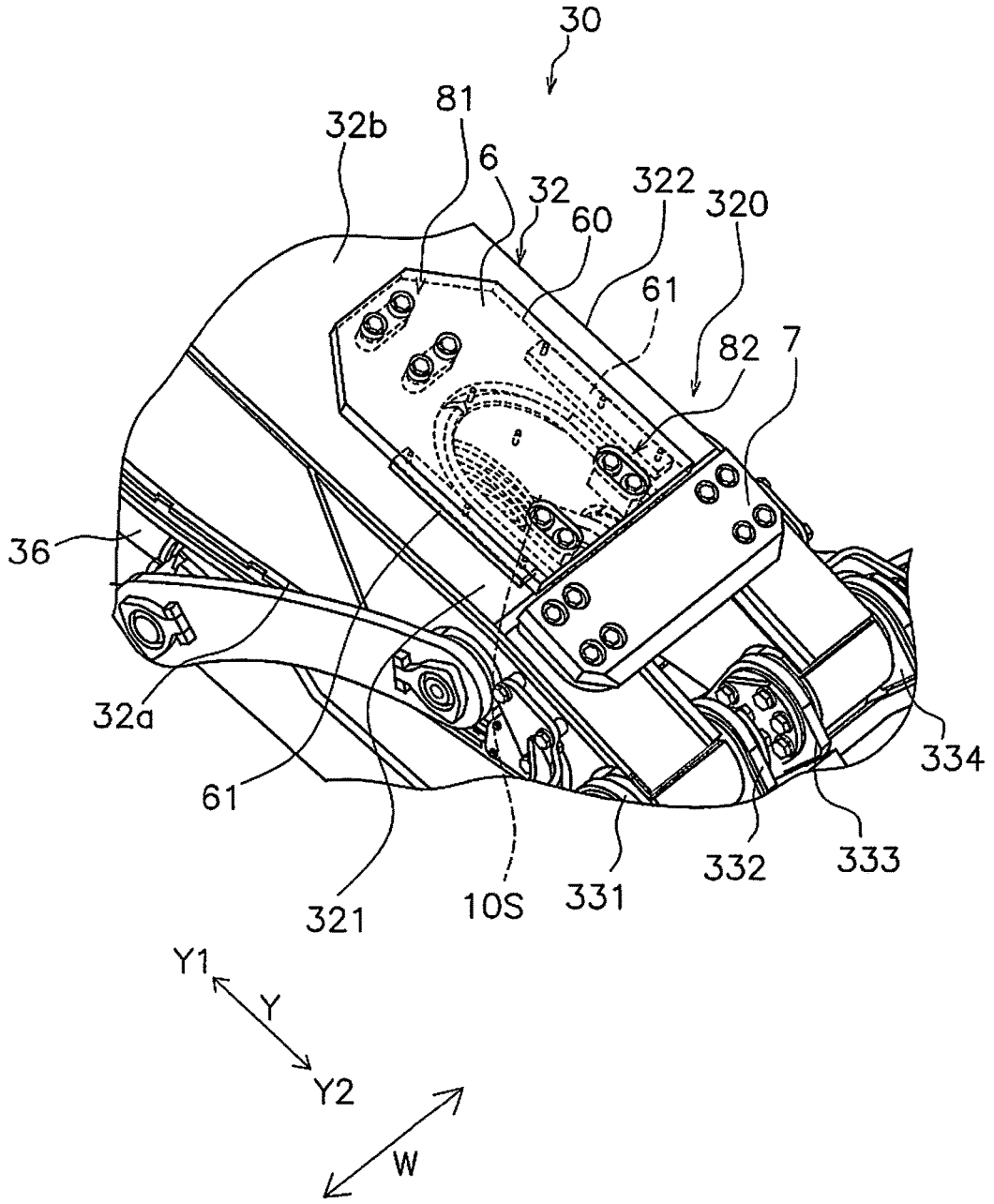
FIG. 4 is a detail view of the configuration near the distal end part of the arm in FIG. 2.
Figure 5:
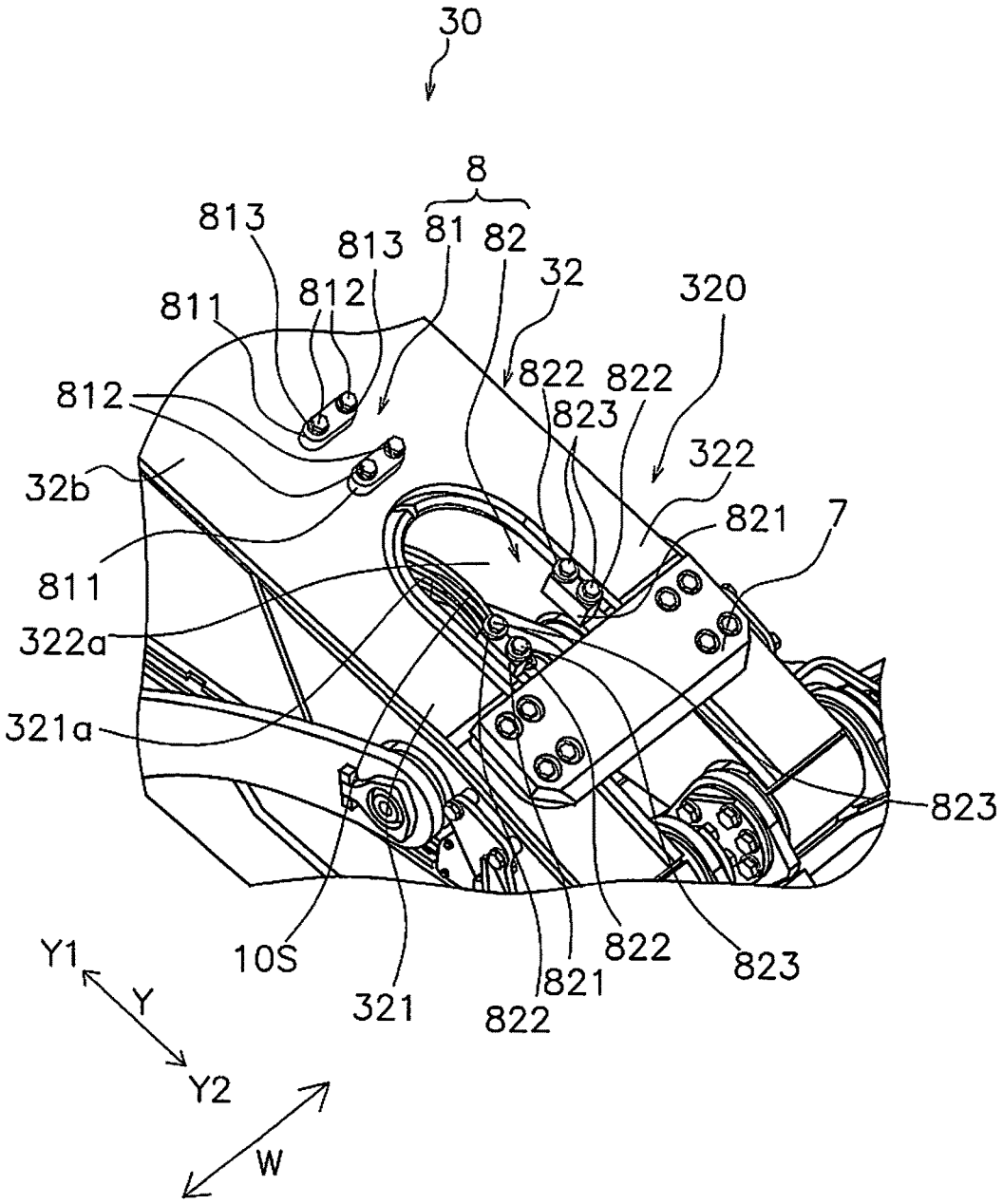
FIG. 5 is a detail view of the area near the distal end part of the arm in FIG. 2 in a state in which a first protector has been removed.

The first protector 6 is a substantially flat member, and is attached to the second face 32*b* of the arm main body 32. The first protector 6 is disposed more on the proximal end part 323 side (see the arrow Y1) than the second protector 7. In FIG. 4, the configuration under the first protector 6 in FIG. 3 is indicated by dotted lines. FIG. 5 shows the state when the first protector 6 has been removed.

As shown in FIG. 4, the first protector 6 is disposed from the first end component 321 to the second end component 322 so as to cover part of the space 105.

The first protector 6 mainly has a cover 60 and two rod members 61.

Figure 6A:
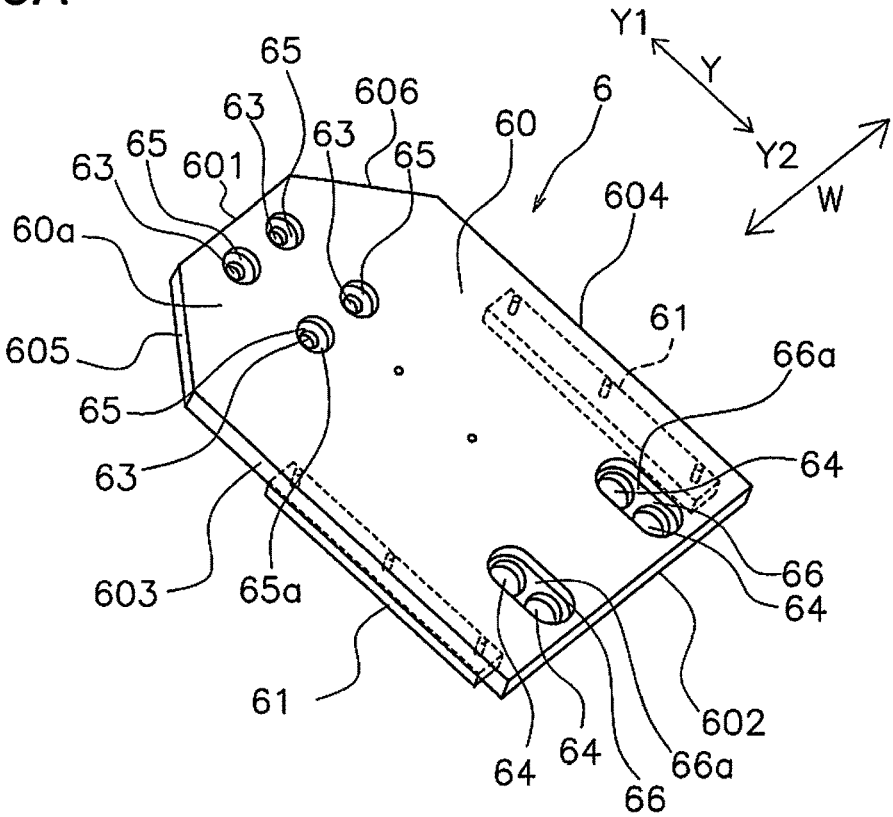
FIG. 6A is an oblique view of the first protector in FIG. 3 as seen from the front side.
Figure 6B:
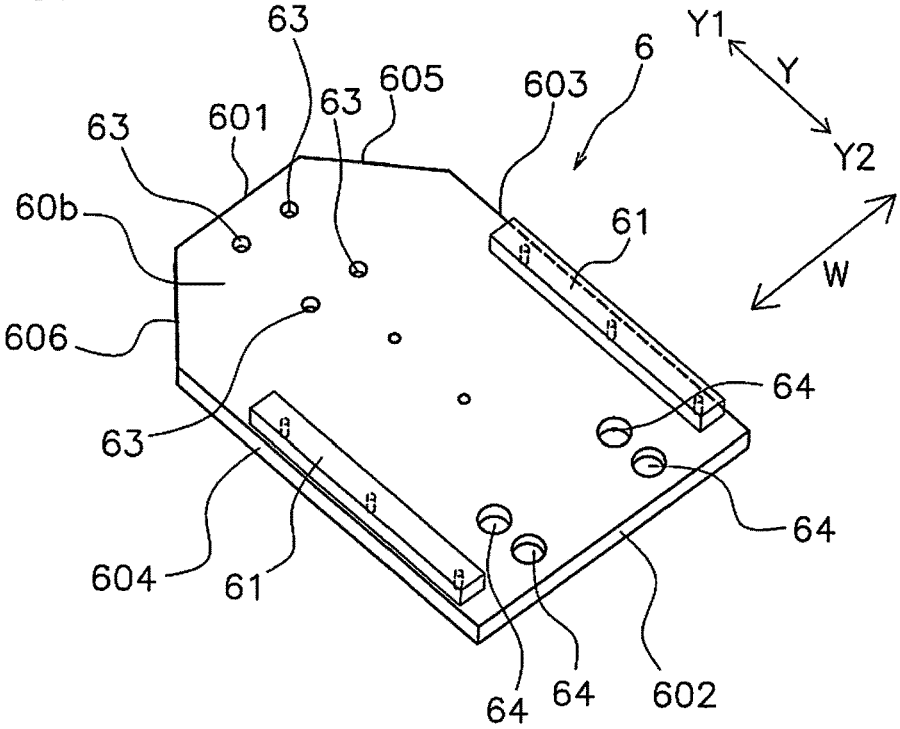
FIG. 6B is an oblique view of the first protector in FIG. 3 as seen from the back side.
Figure 6C:
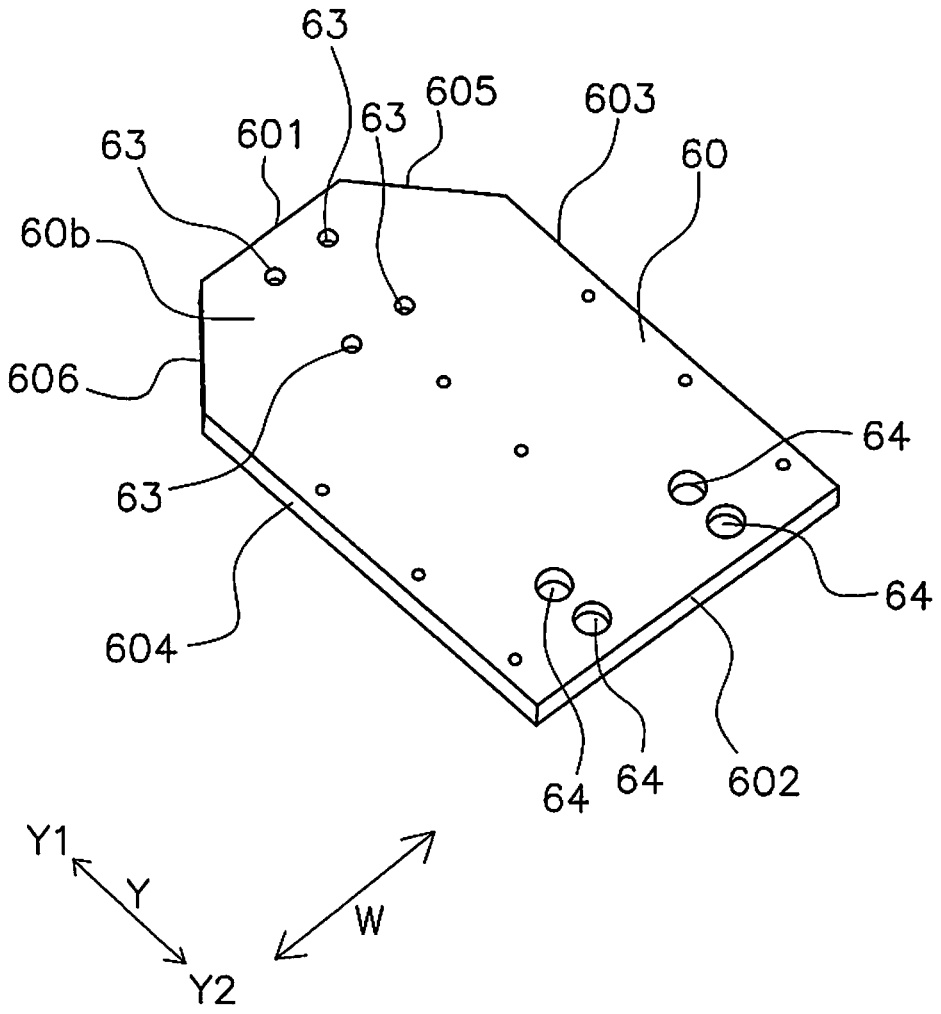
FIG. 6C is an oblique view of the cover of the first protector in FIG. 6B.

FIG. 6A is an oblique view of the first protector 6 as seen from the front side, and FIG. 6B is an oblique view of the first protector 6 as seen from the back side. FIG. 6C is an oblique view of the cover 60 as seen from the back side.

As shown in FIGS. 6A and 6B, the cover 60 is a flat member having a shape in which two of the adjacent corners have been cut off from a rectangular shape, and is therefore a hexagonal member. In a state of being attached to the arm main body 32, the cover 60 has a first side 601 and a second side 602 that are formed along the width direction W and are opposite each other, and a third side 603 and a fourth side 604 that are formed along the lengthwise direction Y of the arm main body 32 and are opposite each other. The first side 601 is disposed on the proximal end part 323 side of the cover 60, and is formed shorter than the second side 602. A fifth side 605 that is inclined to the lengthwise direction Y is provided between one end in the width direction W of the first side 601 and the end on the proximal end part 323 side of the third side 603 (see the arrow Y1), and a sixth side 606 that is inclined to the lengthwise direction Y is provided between the other end in the width direction W of the first side 601 and the end on the proximal end part 323 side of the fourth side 604.

Four recesses 65 are formed near the first side 601 of the cover 60 and toward the center in the width direction W. Two of the four recesses 65 are disposed in the width direction W, and two are disposed in the lengthwise direction Y.

As shown in FIGS. 6A to 6C, through-holes 63 that pass through from the bottom faces 65*a* of each of the recesses 65 (see FIG. 6A) to the rear face 60*b* are formed in the cover 60.

Also, two recesses 66 are formed near the second side 602 of the cover 60. The recesses 66 are formed slender in the lengthwise direction Y, and are provided parallel to each other.

Two through-holes 64 are formed in each of the recesses 66, from the bottom face 66*a* to the rear face 60*b*. The two through-holes 64 are disposed along the lengthwise direction Y.

As shown in FIGS. 6A and 6B, the two rod members 61 have a slender, cuboid shape, and both have the same shape. One of the two rod members 61 is disposed parallel to the third side 603, near the third side 603. The other rod member 61 is disposed parallel to the fourth side 604, near the fourth side 604. The two rod members 61 are thus disposed parallel to each other, and the two recesses 66 and the four through-holes 63 are formed in between the two rod members 61 in the width direction W.

1-2-3. Attachment Component

The structure for attaching the first protector 6 to the arm main body 32 will now be described.

As shown in FIG. 5, the attachment component 8 of the first protector 6 to the arm main body 32 is provided near the distal end part 320 of the arm main body 32.

As shown in FIGS. 4 and 5, the attachment component 8 has a fixing component 81 that fixes the first protector 6, and a restrictor 82 that restricts the movement of the first protector 6.

1-2-3-1. Fixing Component

As shown in FIG. 5, the fixing component 81 is provided on the proximal end part 323 side of the space 10S (see the arrow Y1), in the center in the width direction W. The fixing component 81 has two sets, each set consisting of a seat 811, two bolts 812, and two washers 813. The seats 811 are members formed longer in the width direction W, and are fixed by welding or the like to the second face 32*b* of the arm main body 32.

Figure 7:
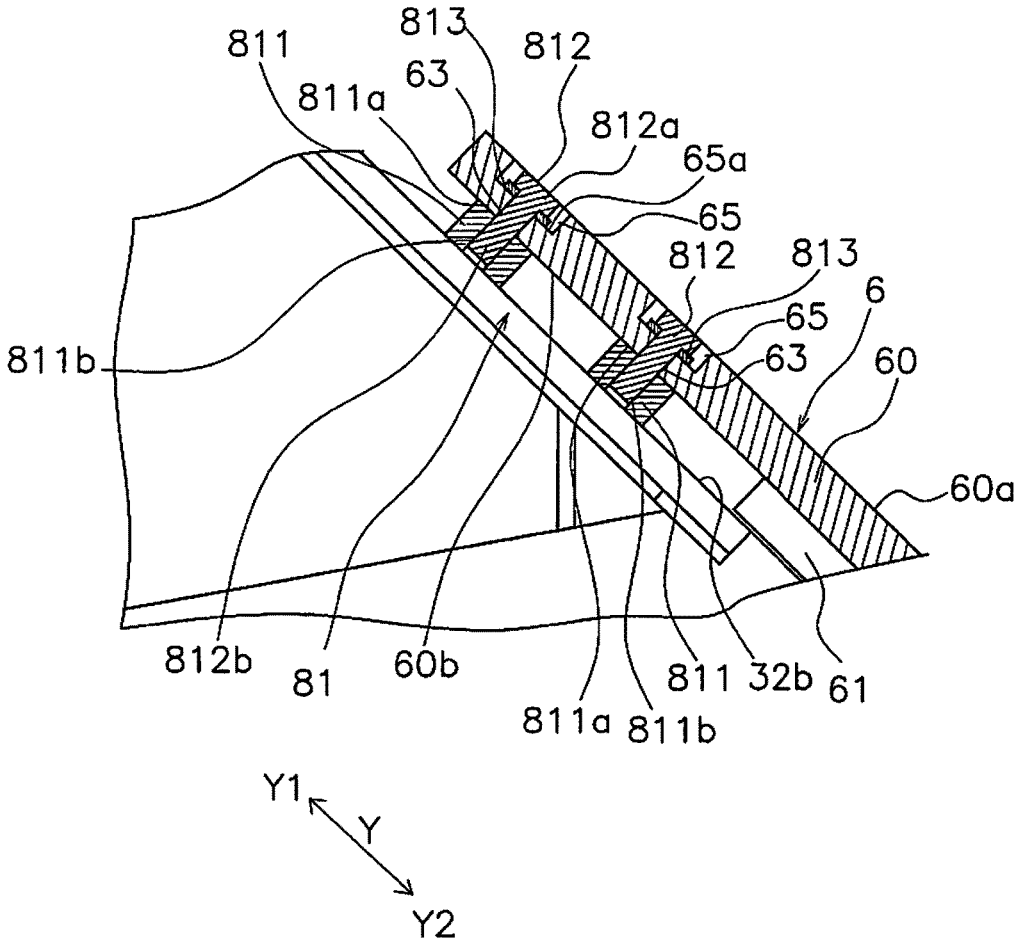
FIG. 7 is a cross section of a fixing component and the first protector along the A-A' line in FIG. 3.

FIG. 7 is a cross section of the fixing component 81 and the first protector 6 along the A-A' line in FIG. 3. As shown in FIG. 7, the upper faces 811*a* of the seats 811 are formed parallel to the second face 32*b*. The two seats 811 are disposed along the lengthwise direction Y, and are parallel to each other.

The first protector 6 is installed on the upper faces 811*a* of the two seats 811, with the rear face 60*b* of the first protector 6 touching the upper faces 811*a*.

Two bolt holes 811*b* that are perpendicular to the upper faces 811*a* are formed in each of the two seats 811, and the positions of the bolt holes 811*b* (four total) correspond to the positions of the four through-holes 63 of the first protector 6 shown in FIGS. 6A to 6C.

The bolts 812 each have a head 812*a* and a shaft 812*b*. The shafts 812*b* are threaded into the through-holes 63 and the bolt holes 811*b* from the front face 60*a* side of the first protector 6. The heads 812*a* fit into the recesses 65 and press the bottom faces 65*a* against the seats 811 via the washer 813.

Thus, the first protector 6 is fixed by the bolts 812 to the seats 811, which are themselves fixed to the arm main body 32.

As shown in FIG. 5, disposing the fixing component 81 in the center in the width direction W reduces the stress that is produced in the fixing component 81 when the arm main body 32 twists, more than when it is disposed toward the outside.

1-2-3-2. Restrictor

The restrictor 82 is provided between the first end component 321 and the second end component 322 in the width direction W, and restricts movement produced by twisting of the first protector 6 during operation of the hydraulic excavator 1. As shown in FIG. 5, the restrictor 82 has two seats 821, four collars 822, and four bolts 823. Two collars 822 and two bolts 823 are disposed on each of the seats 821.

The two seats 821 have a cuboid shape that is longer in the lengthwise direction Y, and are disposed aligned in the width direction W. One of the seats 821 is welded to the side face 321*a* on the space 10S side of the first end component 321. The other seat 821 is welded to the side face 322*a* on the space 10S side of the second end component 322.

Figure 8:
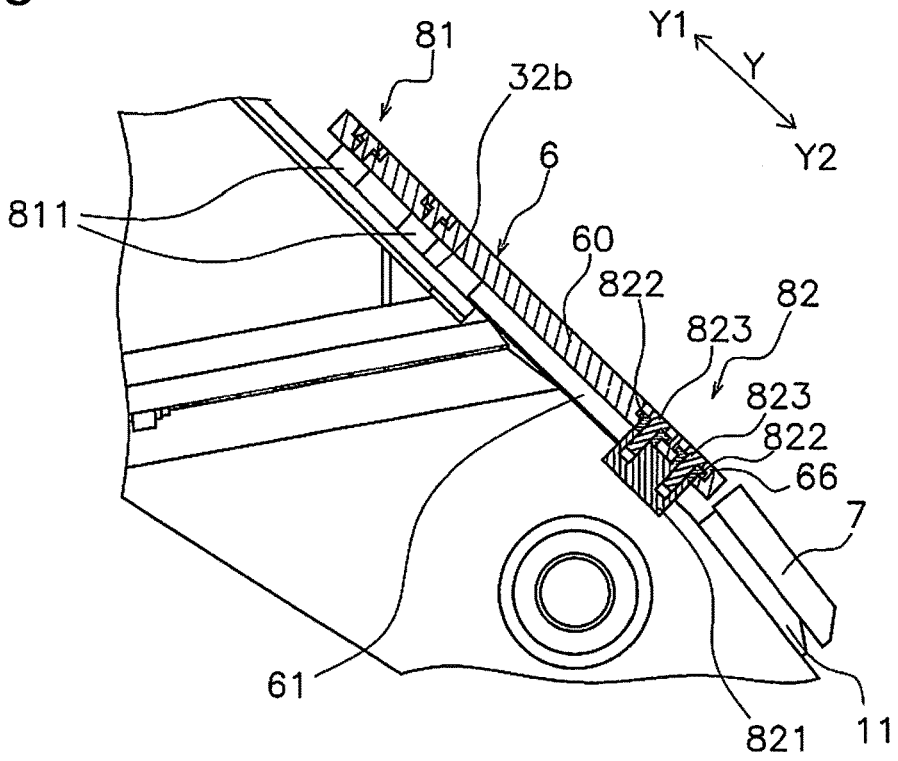
FIG. 8 is a cross section of a restrictor and the first protector along the B-B' line in FIG. 3.
Figure 9:
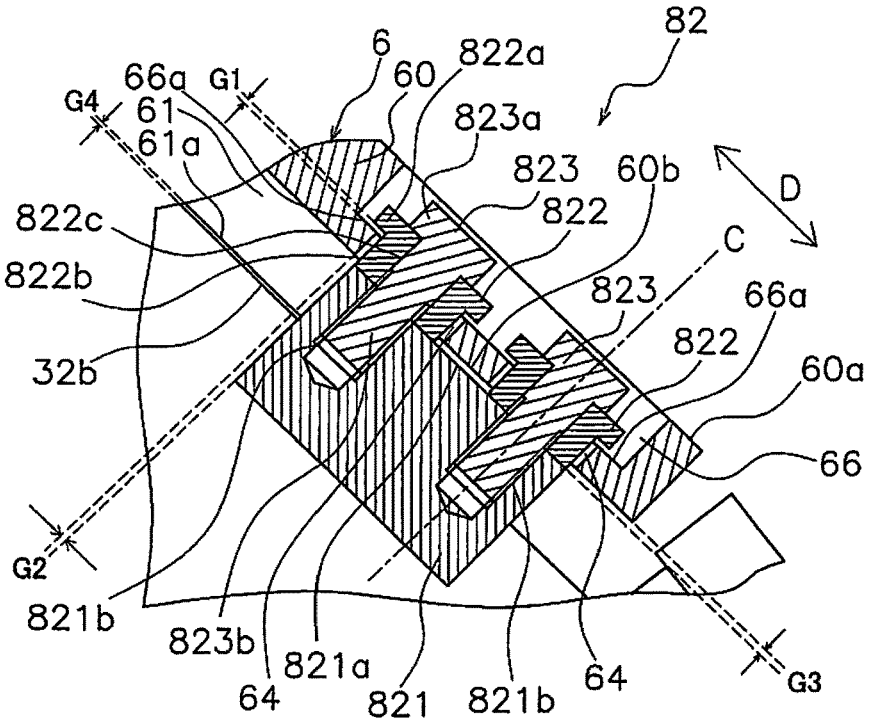
FIG. 9 is a detail view of the area near the restrictor in FIG. 8.

FIG. 8 is a cross section of the first protector 6 and the restrictor 82 along the A-A' line and the B-B' line in FIG. 3. FIG. 9 is a detail view of the area near the restrictor 82 in FIG. 8. The seat 821 fixed on the first end component 321 side is shown in FIGS. 8 and 9, but the seat 821 fixed on the second end component 322 has the same configuration.

The upper faces 821*a* of the seats 821 are formed parallel to the second face 32*b*. The two seats 821 are disposed aligned in the lengthwise direction Y, and are parallel to each other. Two bolt holes 821*b* that are perpendicular to the upper faces 821*a* are formed in each of the seats 821, and the positions of the bolt holes 821*b* (four total) correspond to the positions of the four through-holes 64 of the first protector 6 shown in FIGS. 6A to 6C.

The collars 822 are metal members with a substantially cylindrical shape and having holes 822*c* formed in the center. Their center axis is labeled C, and their radial direction is labeled D. The collars 822 are each formed by a large-diameter part 822*a* that is thick-walled and has a large diameter, and a small-diameter part 822*b* whose diameter is smaller than that of the large-diameter part 822*a*. The small-diameter parts 822*b* of the collars 822 are inserted into the through-holes 64, and the distal ends of the small-diameter parts 822*b* hit the upper faces 821*a* of the seats 821. The large-diameter parts 822*a* of the collars 822 are disposed in the recesses 66.

The bolts 823 each have a head 823*a* and a shaft 823*b*. The shafts 823*b* of the bolts 823 are threaded into the holes 822*c* of the collars 822 and the bolt holes 821*b* from the front face 60*a* side of the first protector 6. The heads 823*a* come into contact with the large-diameter parts 822*a* of the collars 822 from above, and press the collars 822 against the seats 821.

Thus, the collars 822 are fixed to the seats 821 by the bolts 823.

Next, the layout of the collars 822 with respect to the first protector 6 will be described.

As shown in FIG. 9, a gap is formed between the collars 822 and the first protector 6. More precisely, a gap G1 is formed between the bottom faces 66a of the recesses 66 and the large-diameter parts 822*a* of the collars 822 in a direction that runs along the axis X (also called the axial direction). In the radial direction D, a gap G2 is formed between the inner peripheral faces of the through-holes 64 and the small-diameter parts 822*b* of the collars 822. Also, a gap G3 is formed between the rear face 60b of the cover 60 and the upper faces 821*a* of the seats 821. The gap G3 is formed by having the upper faces 821*a* of the seats 821 be located lower than an extension of the upper faces 811*a* of the seats 811 of the fixing component 81 in a side view. Also, FIG. 9 shows the layout relation between the first protector 6 and the restrictor 82 on the first end component 321 side, but the layout relation between the first protector 6 and the restrictor 82 on the second end component 322 side is the same.

In a state in which the hydraulic excavator 1 is not operating and no twisting is being generated at the arm main body 32, the gaps G1, G2, and G3 are formed between the first protector 6 and the restrictor 82, and the first protector 6 is not touching the restrictor 82.

When the arm main body 32 is then subjected to twisting, the first protector 6 is also deformed, but the movement produced by this deformation is restricted when the first protector 6 hits the restrictor 82. For example, if the first protector 6 deforms so as to move away from the second face 32*b* of the arm main body 32, the gap G1 disappears and deformation is restricted by the large-diameter parts 822*a* of the collars 822.

Further, a gap G4 is formed between the second face 32*b* of the arm main body 32 and the lower faces 61*a* of the rod members 61.

Here, the gap G4 is formed narrower than the gap G3. Consequently, when soil, rock, or the like hits the first protector 6, at first the lower faces 61*a* of the rod members 61 come into contact with the second face 32*b* of the arm main body 32, so the welded portion between the seats 811 and the first end component 321 or the second end component 322 is not subjected to any large impact.

1-2-4. Second Protector 7

The second protector 7 is a substantially flat member, and is attached to the second face 32*b* of the arm main body 32 as shown in FIG. 3. The second protector 7 is disposed more to the bucket 33 side (see the arrow Y2) than the first protector 6. The second protector 7 is disposed from the first end component 321 to the second end component 322 so as to cover part of the space 10S.

The seat 11 used for installing the second protector 7 is welded to the first end component 321 portion of the second face 32*b*. Although not shown in the drawings, the seat 11 used for installing the second protector 7 is also welded to the second end component 322 portion of the second face 32*b*.

The second protector 7 is bolted to the seat 11, as with the above-mentioned fixing component 81, at either the first end component 321 or the second end component 322, and at the other one, movement produced by deformation of the second protector 7 is restricted by the collars fixed to the seat 11.

2. Features, Etc.

2-1

As shown in FIG. 1 and FIG. 2, the hydraulic excavator 1 in this embodiment (an example of a work vehicle) comprises the vehicle main body 2 and the arm 30, and the arm 30 has the arm main body 32, the first protector 6 (an example of a protective member), the fixing component 81, and the restrictor 82. The arm main body 32 has the distal end part 320 and the proximal end part 323. The distal end part 320 includes the first end component 321 and the second end component 322 disposed a specific space 10S (an example of a specific space) apart in the width direction W, and the bucket 33 is attached to the distal end part 320. The proximal end part 323 is configured to allow attachment on the vehicle main body 2 side. The first protector 6 covers the specific space 10S. The fixing component 81 is disposed on the proximal end part 323 side of the specific space 10S and fixes the first protector 6 to the arm main body 32. The restrictor 82 is disposed between the first end component 321 and the second end component 322 in the width direction W, and restricts the movement of the first protector 6.

Here, the restrictor 82 that restricts the movement of the first protector 6 is disposed between the first end component 321 and the second end component 322 in the width direction W. If the arm main body 32 should be twisted by operation of the hydraulic excavator 1, there will be less twisting on the inside than the outside in the width direction of the arm main body 32.

Accordingly, disposing the restrictor 82 between the first end component 321 and the second end component 322 in the width direction W reduces the stress that is produced in the structure in which the first protector 6 is attached to the arm main body 32, even if twisting occurs in the arm main body 32.

2-2

As shown in FIG. 4, with the hydraulic excavator 1 in this embodiment (an example of a work vehicle), a gap is formed in at least part of the region between the restrictor 82 and the first protector 6.

Consequently, the first protector 6 is not fixed to the arm main body 32 on the distal end part 320 side where twisting is apt to occur, but the first protector 6 can be fixed on the proximal end part 323 side where twisting is less likely to occur. Accordingly, the stress generated at the restrictor 82 can be reduced on the distal end part 320 side where stress is more likely to occur.

2-3

As shown in FIG. 5, with the hydraulic excavator 1 in this embodiment (an example of a work vehicle), the restrictor 82 has the seats 821 and the collars 822 (an example of a restricting member). The seat 821 is fixed to at least one of the side faces 321*a* on the specific space 10S side of the first end component 321 and the side face 322*a* on the specific space 10S side of the second end component 322. The collars 822 are fixed to the seats 821 via through-holes 64 formed in the first protector 6. As shown in FIG. 9, the gaps G1 and G2 are formed between the collars 822 and the first protector 6.

Thus disposing the seat 821 on at least the side faces 321*a* of the first end component 321 and the side face 322*a* of the second end component 322 reduces the stress produced in the connected portion between the seats 821 and the arm main body 32 more than when the seats 821 are provided on the second face 32*b* to the first end component 321 and second end component 322, which are on the outside.

Also, since the seats 821 are fixed to the side faces 321*a* and 322*a*, when they are fixed with the bolts 823, the bolts 823 of the proper size can be used by adjusting the height, width, and so forth of the seats 821.

2-4

As shown in FIG. 9, with the hydraulic excavator 1 in this embodiment (an example of a work vehicle), the collars 822 (an example of a restricting member) are a cylindrical member, each having a small-diameter part 822*b* that hits a seat 821, and a large-diameter part 822*a* provided on the opposite side of the seat 821 from the small-diameter part 822*b*. The gap G1,G2 are formed between the first protector 6 and the large-diameter parts 822*a* in the axial direction C of the collars 822, and between the first protector 6 and the small-diameter parts 822*b* in the radial direction D of the collars 822.

Thus, since gaps are formed between the collars 822 and the first protector 6 in the radial direction and the axial direction C, the stress produced in the restrictor 82 and the seats 821 when the arm main body 32 twists can be moderated.

2-5

As shown in FIG. 5, with the hydraulic excavator 1 in this embodiment (an example of a work vehicle), the seats 821 are disposed on both the side face 321*a* on the space 10S side of the first end component 321, and on the side face 322*a* on the specific space 10S side of the second end component 322. The collars 822 (an example of a restricting member) are fixed to the seats 821.

Thus disposing both the seats 821 and the collars 822 more reliably prevents soil from getting into the space 10S when soil, rock, or the like hits the protective member.

2-6

As shown in FIG. 4, with the hydraulic excavator 1 in this embodiment (an example of a work vehicle), the first protector 6 (an example of a protective member) has the rod members 61 (an example of a protrusion). The rod members 61 are fixed to the rear face 60*b* (an example of a face) of the cover 60 (an example of a protective member main body) that is opposite the arm main body 32, more on the restrictor 82 side than the fixing component 81 in the arm 30.

Consequently, when soil, rock, or the like hits the first protector 6, the impact on the first protector 6 is borne by not only the restrictor 82, but also by the rod members 61 colliding with the arm main body 32. Accordingly, less of a load is exerted on the portion of the restrictor 82 that is connected to the arm main body 32 during collision with soil.

2-7

As shown in FIG. 9, with the hydraulic excavator 1 in this embodiment (an example of a work vehicle), the restrictor 82 has the seats 821 and the collars 822 (an example of a restricting member). The seat 821 is fixed to at least one of the side faces 321*a* on the space 10S side of the first end component 321 and the side face 322*a* on the space 10S of the second end component 322. The collars 822 are fixed to the seats 821 via the through-holes 64 formed in the first protector 6. The gap G3 is provided between the seats 821 and the cover 60 (an example of a protective member main body). The gap G4 is formed between the rod members 61 (an example of a protrusion) and the arm main body 32. The gap G4 between the rod members 61 and the arm main body 32 is smaller than the gap G3 between the seats 821 and the cover 60.

Consequently, the impact on the first protector 6 when soil, rock, or the like hits the first protector 6 is borne by having the rod members 61 collide with the arm main body 32 prior to the restrictor 82. Accordingly, less of a load is exerted on the portion of the restrictor 82 that is connected to the arm main body 32 during collision with soil.

2-8

With the hydraulic excavator 1 in this embodiment (an example of a work vehicle), the rod members 61 (an example of a protrusion) are provided in at least two places that are opposite each other on the first end component 321 and the second end component 322. The rod members 61 are formed in a rod shape along the first end component 321 and the second end component 322.

When the rod members 61 are thus formed in a rod shape, the impact that occurs as a result of the collision of soil or the like with the first protector 6 can be borne over a larger surface area.

2-9

The aim 30 pertaining to the this embodiment comprises the arm main body 32, the first protector 6 (an example of a protective member), the fixing component 81, and the restrictor 82. The arm main body 32 has the distal end part 320 and the proximal end part 323. The distal end part 320 has the first end component 321 and the second end component 322 disposed a specific space 10S apart in the width direction W, and the bucket 33 is attached to the distal end part 320. The proximal end part 323 is configured to allow attachment on the vehicle main body 2 side. The first protector 6 covers the specific space 10S. The fixing component 81 is disposed on the proximal end part 323 side of the specific space 10S and fixes the first protector 6 to the arm main body 32. The restrictor 82 is disposed between the first end component 321 and the second end component 322 in the width direction W, and restricts the movement of the first protector 6.

Here, the restrictor 82 that restricts the movement of the first protector 6 is disposed between the first end component 321 and the second end component 322 in the width direction W. If the arm main body 32 should be twisted by operation of the hydraulic excavator 1, there will be less twisting on the inside than the outside in the width direction of the arm main body 32.

Accordingly, disposing the restrictor 82 between the first end component 321 and the second end component 322 in the width direction W reduces the stress that is produced in the structure in which the first protector 6 is attached to the arm main body 32, even if twisting occurs in the arm main body 32.

2-10

The work implement 3 pertaining to this embodiment comprises the boom 31, the arm 30, and the bucket 33. The boom 31 can be pivotably attached to the vehicle main body 2. The arm 30 is attached to the boom 31. The bucket 33 is attached to the arm 30. The arm 30 has the arm main body 32, the first protector 6 (an example of a protective member), the fixing component 81, and the restrictor 82. The arm main body 32 has the distal end part 320 and the proximal end part 323. The distal end part 320 includes the first end component 321 and the second end component 322 disposed the specific space 10S apart in the width direction W, and the bucket 33 is attached to the distal end part 320. The proximal end part 323 is attached to the boom 31. The first protector 6 covers the specific space 10S. The fixing component 81 is disposed on the proximal end part 323 side of the specific space 10S and fixes the first protector 6 to the arm main body 32. The restrictor 82 is disposed between the first end component 321 and the second end component 322 in the width direction W, and restricts the movement of the first protector 6.

Here, the restrictor 82 that restricts the movement of the first protector 6 is disposed between the first end component 321 and the second end component 322 in the width direction W. If the arm main body 32 should be twisted by operation of the hydraulic excavator 1, there will be less twisting on the inside than the outside in the width direction W of the arm main body 32.

Accordingly, disposing the restrictor 82 between the first end component 321 and the second end component 322 in the width direction W reduces the stress that is produced in the structure in which the first protector 6 is attached to the arm main body 32, even if twisting occurs in the arm main body 32.

3. Other Embodiments

An embodiment of the present invention was described above, but the present invention is not limited to or by the above embodiment, and various modifications are possible without departing from the gist of the invention.

(A)

Figure 10:
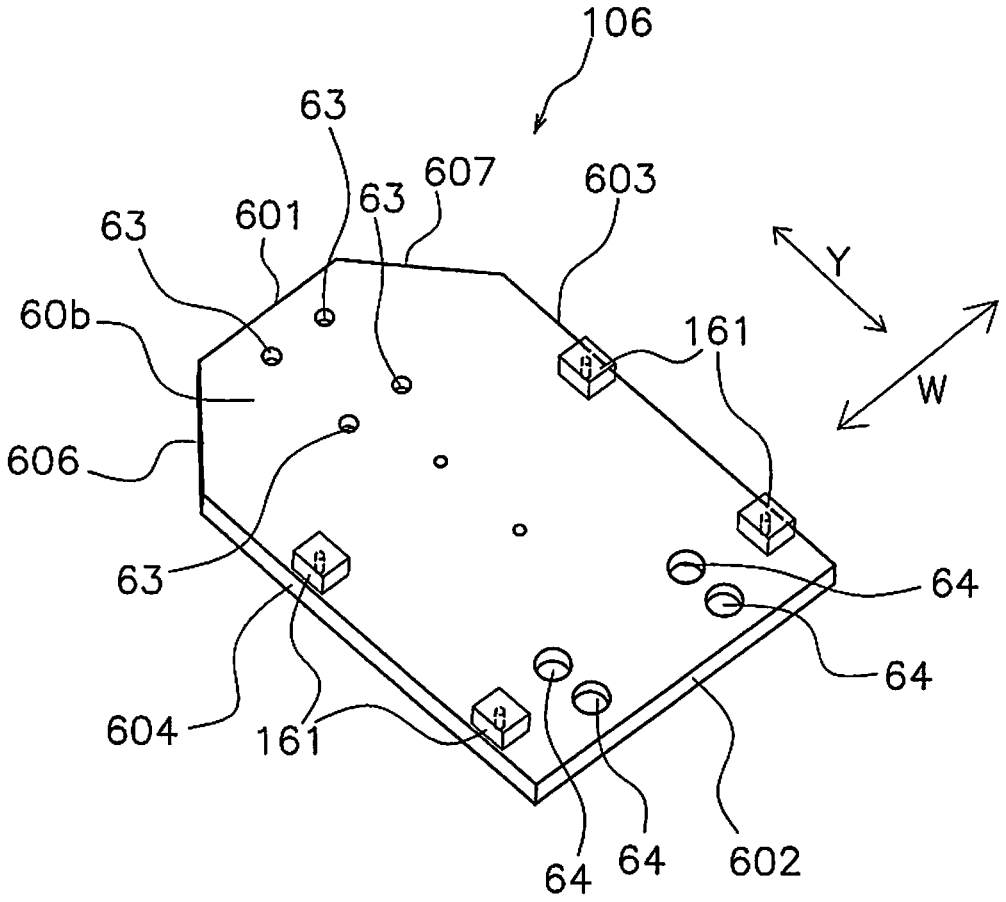
FIG. 10 is an oblique view of the configuration of the first protector in a modification example of the embodiment pertaining to the present invention.
Figure 11:
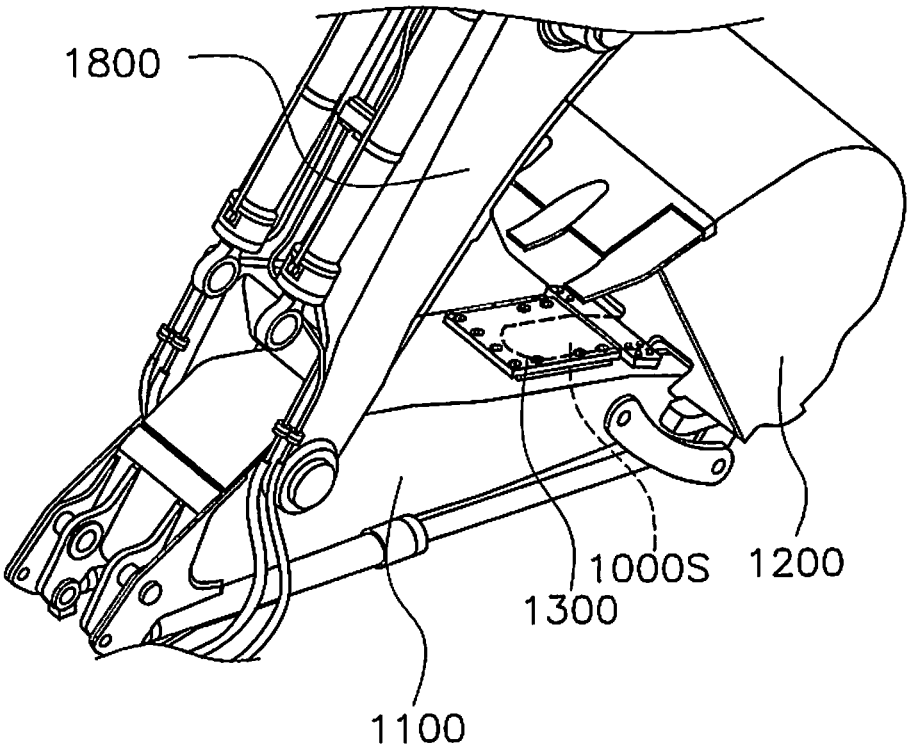
FIG. 11 is an oblique view of the area near the arm in a conventional hydraulic excavator.
Figure 12:
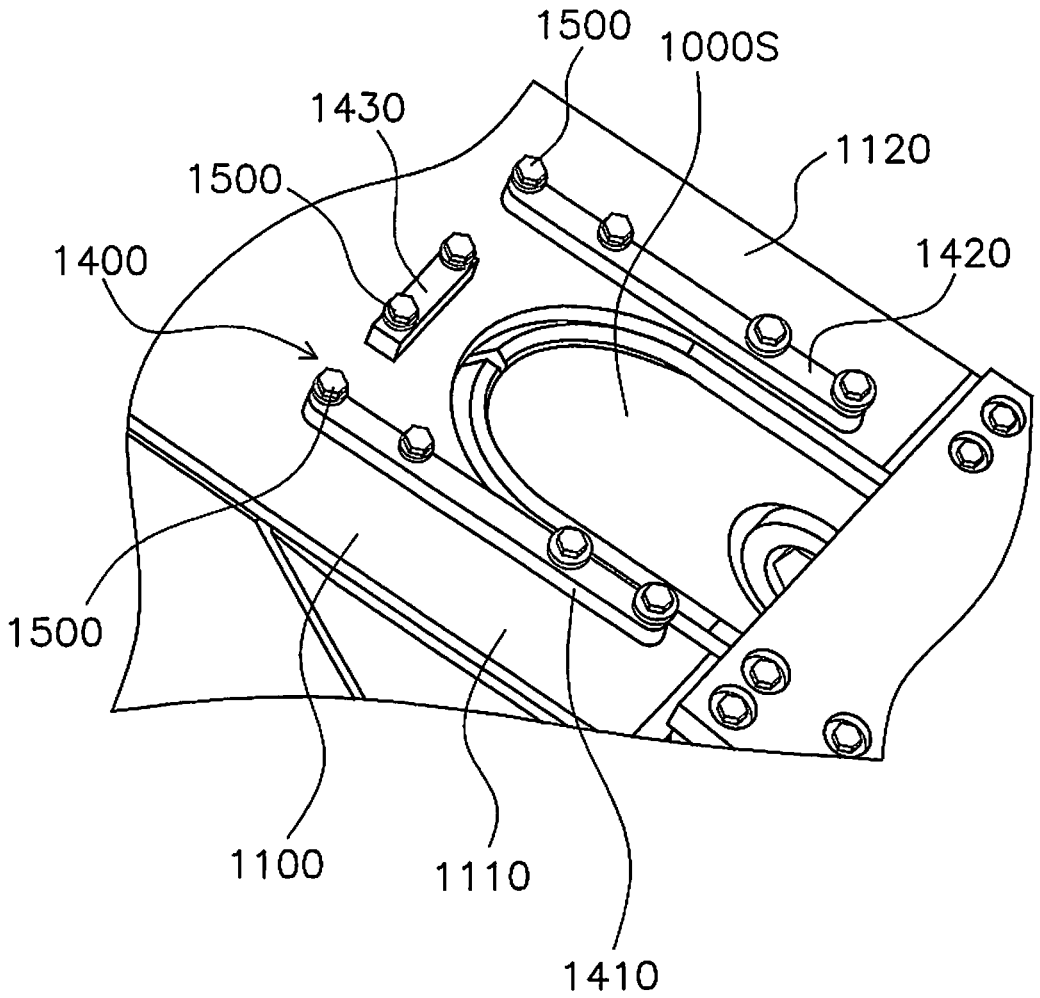
FIG. 12 is an oblique view of the area near the distal end part of the arm in FIG. 11.
Figure 13:
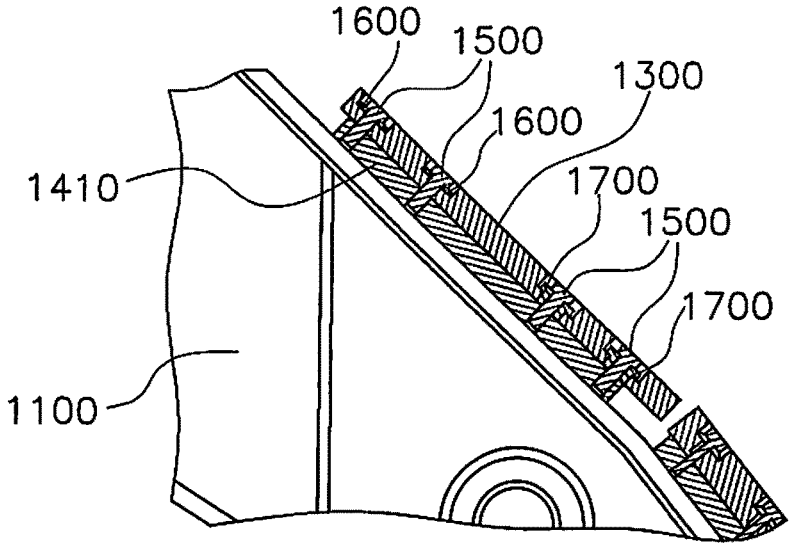
FIG. 13 is a cross section of the configuration of an attachment component and the protector in FIG. 11.
Figure 14:
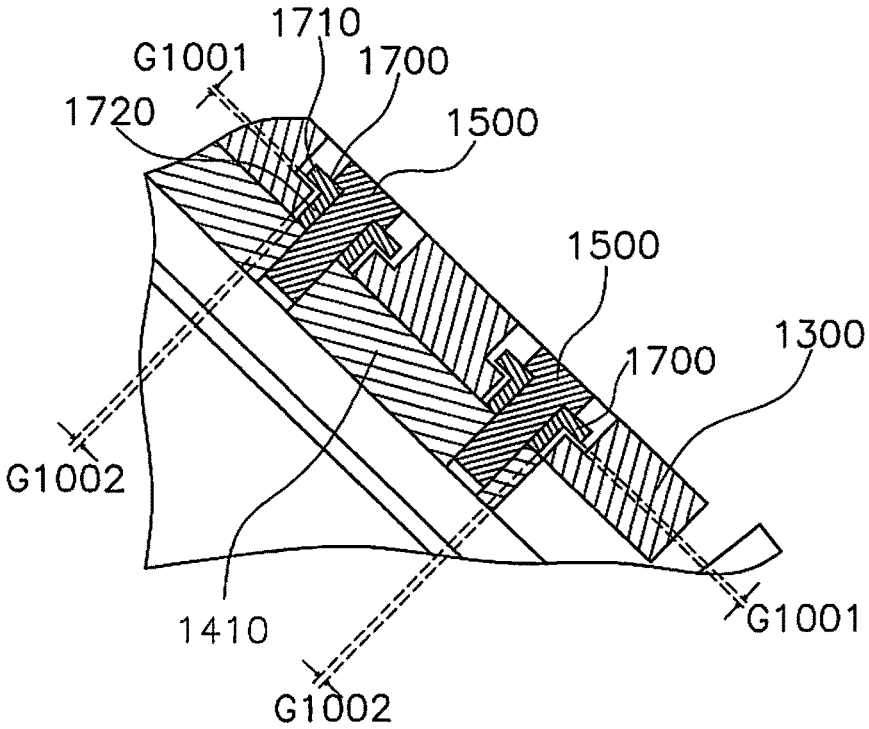
FIG. 14 is a detail view of FIG. 13.

The rod members 61 are provided to the first protector 6 in the above embodiment, but these need not be rod-shaped. For example, as with the first protector 106 shown in FIG. 10, a plurality of protrusions 161 may be disposing along the third side 603 and the fourth side 604. In FIG. 10, two of the protrusions 161 are provided on the third side 603 and two on the fourth side 604, but the number is not limited to two.

Also, the rod members 61 need not be provided at all, but providing them is preferable from the standpoint of strength when rock or the like hits.

(B)

The first protector 6 in the above embodiment is hexagonal, but this is not the only option. For instance, the shape of the first protector 6 may be tetragonal, or it may be elliptical.

(C)

The first protector 6 and the second protector 7 are provided in the above embodiment, but the second protector 7 need not be provided, and the first protector 6 may be formed longer in the lengthwise direction Y.

(D)

In the above embodiment, the restrictor 82 has a set of seats 821, collars 822, and bolts 823 for each of the side face 321*a* of the first end component 321 and the side face 322*a* of the second end component 322, but this is not the only option. For instance, the seats 821, the collars 822, and the bolts 823 may be provided on just the first end component 321 side or the second end component 322 side.

(E)

Two of the collars 822 are fixed by the bolts 823 to a single seat 821 in the above embodiment, but there may be just one collar 822, or there may be three or more.

INDUSTRIAL APPLICABILITY

The work implement, arm, and work vehicle pertaining to the present invention have the effect of reducing the stress produced in a protective member attachment structure, and therefore can be widely applied to various kinds of work vehicle, such as a hydraulic excavator.

The invention claimed is:

1. A work vehicle comprising;
- a vehicle main body; and
- an arm, the arm including
  - an arm main body having
    - a distal end part with a first end component and a second end component disposed a specific space apart along a width direction,
    - a bucket attached to the arm main body, and
    - a proximal end part configured to allow attachment on a vehicle main body side,
  - a protective member covering the specific space,
  - a fixing component disposed on a proximal end part side of the specific space and fixing the protective member to the arm main body, and
  - a restrictor disposed between the first end component and the second end component along the width direction, and restricting movement of the protective member.

2. The work vehicle according to claim 1, wherein
- a gap is formed in at least part of a region between the restrictor and the protective member.

3. The work vehicle according to claim 1, wherein the restrictor includes
- a seat fixed to at least one of a side face on a specific space side of the first end component and a side face on the specific space side of the second end component, and
- a restricting member fixed to the seat via a through-hole formed in the protective member, and
- a gap is formed between the restricting member and the protective member.

4. The work vehicle according to claim 3, wherein
- the restricting member is a cylindrical member, and has a small-diameter part that comes into contact with the seat, and a large-diameter part provided on an opposite side of the seat from the small-diameter part, and
- the gap is formed between the protective member and the large-diameter part along an axial direction of the restricting member, and between the protective member and the small-diameter part along a radial direction of the restricting member.

5. The work vehicle according to claim 3, wherein the seat is disposed on both the side face on the specific space side of the first end component, and the side face on the specific space side of the second end component, and the restricting member is fixed to each of the seats.

6. The work vehicle according to claim 2, wherein the protective member has a protrusion fixed to a face of a protective member main body that is opposite the arm main body, more on a restrictor side of the arm than the fixing component.

7. The work vehicle according to claim 6, wherein the restrictor includes a seat fixed to at least one of a side face on a specific space side of the first end component and a side face on the specific space side of the second end component, and a restricting member fixed to the seat via a through-hole formed in the protective member, and the gap is formed between the seat and the restricting member main body, an additional gap is formed between the protrusion and the arm main body, and the additional gap between the protrusion and the arm main body is smaller than the gap between the seat and the protective member main body.

8. The work vehicle according to claim 6, wherein the protrusion is provided in at least two places that are opposite each other on the first end component and the second end component, and the protrusions are formed in a rod shape along the first end component and the second end component.

9. An arm, comprising:

an arm main body a distal end part with a first end component and a second end component disposed a specific space apart along a width direction, a bucket attached to the distal end part, and a proximal end part which is configured to allow attachment on a vehicle main body side;

a protective member covering the specific space;

a fixing component disposed on a proximal end part side of the specific space and fixing the protective member to the arm main body; and a restrictor disposed between the first end component and the second end component along the width direction, and restricting movement of the protective member.

10. A work implement, comprising:

a boom pivotably attachable to a vehicle main body;

an arm attached to the boom; and a bucket attached to the arm, the arm including an arm main body having a distal end part a first end component and a second end component disposed a specific space apart along a width direction, and a proximal end part attached to the boom, the bucket being attached to the distal end part, a protective member covering specific space, a fixing component disposed on a proximal end part side of the specific space and fixing the protective member to the arm main body, and a restrictor disposed between the first end component and the second end component along the width direction, and restricting movement of the protective member.

* * * * *